United States Patent [19]

Beran et al.

[11] 4,382,593

[45] May 10, 1983

[54] VACUUM DOCUMENT FEEDER

[75] Inventors: Mark A. Beran, Boulder County; Donald F. Colglazier, Longmont, both of Colo.

[73] Assignee: International Business Machines Corporation, Armonk, N.Y.

[21] Appl. No.: 175,172

[22] Filed: Aug. 4, 1980

[51] Int. Cl.[3] ..... B65H 3/08; B65H 3/12

[52] U.S. Cl. ..... 271/12; 271/93; 271/98; 271/103; 271/104; 271/108

[58] Field of Search ..... 271/12, 11, 13, 97, 271/98, 91, 94, 103, 104, 107, 108, 251, 93, 14, 271/15, 5; 414/116, 121; 198/816

[56] References Cited

U.S. PATENT DOCUMENTS

| | | | |
|---|---|---|---|
| 900,782 | 10/1908 | Richards . | |
| 1,853,781 | 4/1932 | Rider . | |
| 1,861,605 | 6/1932 | Maass . | |
| 2,085,612 | 6/1937 | Spiess . | |
| 2,374,578 | 4/1945 | Bernard et al. . | |
| 2,497,849 | 2/1950 | Aberle | 271/12 |
| 3,035,685 | 5/1962 | Raynor | 198/816 X |
| 3,404,789 | 10/1968 | Georgeff et al. . | |
| 3,584,866 | 6/1971 | Ross et al. | 271/12 |
| 3,614,089 | 10/1971 | Van Auken et al. | 271/94 |
| 3,627,308 | 12/1971 | Stoever . | |
| 3,635,464 | 1/1972 | Gramlich | 271/18 R |
| 3,884,368 | 5/1975 | Ballard | 414/121 |
| 3,977,672 | 8/1976 | Godlewski | 271/264 |
| 3,990,696 | 11/1976 | Landa | 271/98 X |
| 4,027,872 | 6/1977 | Bueker | 271/170 |
| 4,173,335 | 11/1979 | Janecek et al. | 271/12 X |
| 4,203,585 | 5/1980 | Kunz et al. | 271/4 |

FOREIGN PATENT DOCUMENTS

| | | | |
|---|---|---|---|
| 2039860 | 2/1973 | Fed. Rep. of Germany | 271/12 |
| 2502668 | 7/1976 | Fed. Rep. of Germany . | |
| 1429483 | 3/1976 | United Kingdom . | |
| 1446104 | 8/1976 | United Kingdom . | |

OTHER PUBLICATIONS

Brooke, E. R. et al., "Sheet Separator With Belt Transport", *Xerox Disclosure Journal*, vol. 4, No. 1, Jan./Feb. 1979, pp. 55–56.

*Primary Examiner*—Bruce H. Stoner, Jr.
*Attorney, Agent, or Firm*—J. G. Cockburn; C. E. Rohrer

[57] ABSTRACT

An automatic vacuum document feeder particularly adapted for feeding sheet-like documents in seriatim from a stack onto a utilization device, such as the document platen of a convenience copier. The documents are disposed in a tray. A vacuum lifter descends and lifts the topmost document along a vertical path to a position above the stack and beyond the bottom surface of a vacuum transport. The vacuum transport is disposed in a plane perpendicular to the vertical path of the vacuum lifter. The vacuum transport strips the document from the vacuum lifter and transports the document to the utilization device. The entire system is configured so that there is no relative motion occurring between the document being transported and the transport hardware. A document restraint device, including air jets and stripper fingers, coact with the stack to eliminate double feed.

6 Claims, 11 Drawing Figures

VACUUM DOCUMENT FEEDER

BACKGROUND OF THE INVENTION

1. Field of the Invention

The present invention relates generally to apparatus for separating individual sheet-like material from a stack and feeding the same to a utilization device. More particularly, the present invention relates to a vacuum type picker mechanism.

2. Prior Art

The use of devices which separate sheet-like articles from a stack and transport the same to utilization apparatuses for further processing are well known in the prior art.

The prior art devices can be broadly divided into two classes. One type of prior art device is adapted for handling relatively stiff sheet-like articles such as veneer sheets, metal sheets or the like. The other type of prior art devices are adapted to handle flexible sheet-like articles such as paper sheets.

U.S. Pat. No. 3,404,789 is an example of the first type of prior art device. The patent describes a prior art device for separating and transporting stiff sheet-like articles such as metal sheets. Stacks of the articles are loaded sequentially onto a support platform. A pick-up device consisting of a pair of vertically reciprocating vacuum pick-ups is descended onto the stack. The topmost metal sheet is picked up and transported by the vacuum pick-ups along a vertical path to a transition zone above the stack. Several magnetic rails are placed in spaced relation at the transition zone. As the vacuum pick-ups retract beyond the bottom surface of the magnetic rails, the metal sheets are magnetically attracted and supported by the rails. A horizontal transport assembly having a plurality of rollers, are interspersed between the magnetic rails. The configuration between the magnetic rails and the rollers are such that the surfaces of the rollers extend slightly beyond the surface of the magnetic rail. The rollers are mounted when the levers are activated on spaced apart shafts and the shafts are connected to mechanical levers. A sheet which is held by the magnetic rail is shifted axially along the rollers.

German Pat. No. 2,502,668 describes an apparatus for lifting and removing veneer sheets from a stack and transporting said sheets to a utilization station. The topmost veneer sheet in the stack is lifted and is held against a movable conveyor belt by a vacuum lifting means. The movable conveyor belt transports the veneer sheet so that the leading edge contacts a rotating brush. The sheet is driven, by the brush, into the utilization station.

German Pat. No. 2,353,774 further describes an apparatus for separating damp veneer sheets. An air blast having adjustable frequency is used to separate the veneer sheet.

Although the above-described prior art apparatuses function satisfactorily for the intended purposes, they are affected by two defects. In the first instance, these apparatuses have limited application. Primarily, they can transport only relative stiff material. Additionally, this prior art device tends to scratch (that is damage) the work pieces. The last defect stems from the fact that there is always relative motion between the work piece and the conveying devices.

U.S. Pat. No. 3,977,672 is an example of the other type of prior art apparatus adapted for handling flexible sheet material, such as paper. The apparatus is adaptable to be positioned between a feed mechanism and a printing machine. The apparatus consists of a vacuum pick-up leg swingably mounted between the feed mechanism and the print press. The vacuum pick-up leg is disposed above a support table. Sheets which are delivered onto the support table are lifted through an arcuate path by the vacuum pick-up leg and delivered to a pair of feed rolls.

U.S. Pat. No. 3,627,308 describes another prior art apparatus suitable to separate and transport paper sheets. The apparatus consists of a plurality of movable riffling fingers disposed relative to one edge of a stack of sheets. The riffling fingers further control the size of a plurality of orifices through which air escapes to fluff the sheets. As the position of the riffling fingers are adjusted from an initial position to a transitional point, a vacuum picker foot, which is disposed above the stack, lifts the topnost sheet from the stack.

United Kingdom Pat. No. 1,429,483 discloses the use of a vacuum picker to pick up a document from a stack and a vacuum belt to transport the document.

United Kingdom Pat. No. 1,446,104 discloses a vacuum document feed wherein an air jet system is used to separate the uppermost sheet from a stack of sheets. A transport assembly consisting of a vacuum pick-up member, feed rollers and conveyor belt transport the sheet from the stack to a utilization point.

The primary problem which is associated with the last mentioned type of prior art devices, is that these devices are susceptible of damaging the documents. The damage stems primarily from the rubbing action (caused by the relative motion between the document and the conveying devices).

In document handling devices, particularly devices used to feed original documents, it is important that there be no scrubbing action between the document and feed mechanism or the document and the stack. Such scrubbing will result in damage to the original documents. Due to the defects associated with the prior art document handling devices, those devices are not suitable to handle original documents.

Although the invention to be described hereinafter finds use with both types of prior art devices, it is of maximum importance in feeding flexible material, including original documents. In this application there is no scrubbing action between the original document and the transport devices. Therefore, the damage to the document is eliminated.

SUMMARY OF THE INVENTION

It is an object of the invention to feed sheet-like material in a more efficient manner than was heretofore possible.

It is another object of the invention to pick, separate and feed documents without damaging the documents.

The defects associated with prior art document feeders are overcome by the automatic vacuum document feeder according to the teaching of the present invention.

The automatic document feeder includes a plurality of spaced vacuum lifters. The vacuum lifters are suspended above a document support tray. The vacuum lifters are controlled to descend onto a stack of sheets positioned on the document support tray. The topmost sheet is lifted and is transported along a linear vertical path to a transition zone above the stack. A vacuum transport belt assembly is disposed at the transition zone. The vacuum transport belt assembly is positioned so that the vacuum drive belt moves in a plane perpendicular to the plane in which the vacuum lifter transports the topmost sheet. As the vacuum lifter retracts beyond the bottom surface of the vacuum drive belt, the vacuum to the lifter is disconnected and the sheet is delivered to the transport belt.

In one feature of the invention, a document restraint means including a vacuum puffer and separator fingers are disposed relative to one edge of the stack. The document restraint coats with the stack to eliminate double feed.

The foregoing and other features and advantages of the invention will be apparent from the following more particular description of the preferred embodiment of the invention, as illustrated in the accompanying drawings.

DESCRIPTION OF THE PREFERRED EMBODIMENT

Figure 1:
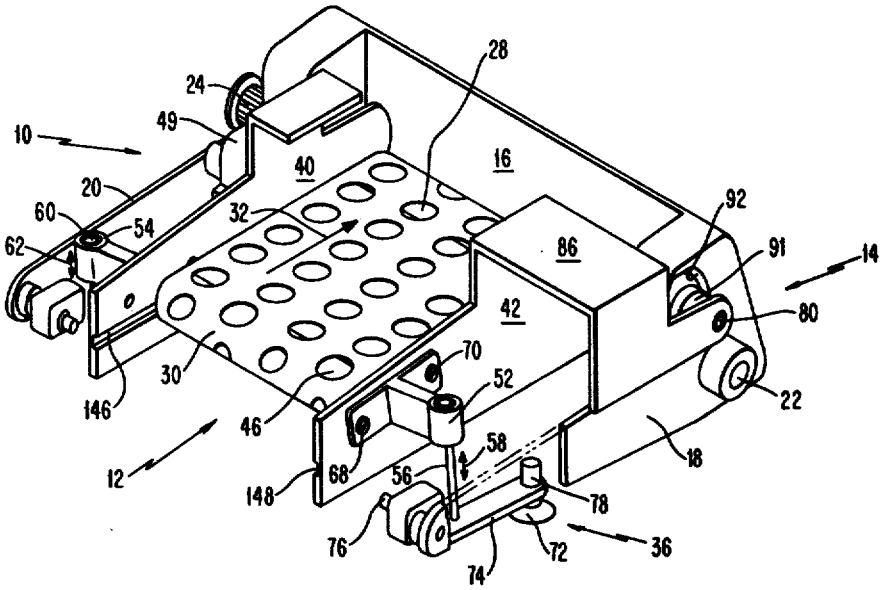
FIG. 1 shows a perspective view of an automatic document feeder according to the teachings of the present invention.

Referring now the drawings, and in particular, FIG. 1, an automatic vacuum document feeder 10 is shown. The automatic vacuum document feeder 10 includes a lifter/transport assembly 12, coupled to a support frame 14. The support frame 14 is substantially U-shaped with a back wall 16 and spaced side members 18 and 20 respectively. A shaft 22 is journaled for rotation in side members 18 and 20 respectively. A grooved pulley 24 is attached to one end of shaft 22. The pulley is coupled through drive belt 26 (FIG. 2) to a drive motor (not shown). A cylindrical drive roller 28 is fixedly mounted to the central portion of shaft 22. As will be explained hereinafter, by rotating shaft 22 through belt 26 (FIG. 2), an endless vacuum transport belt 30 which is coupled to cylindrical drive roller 28 is transported in the direction shown by arrow 32. As such, a paper sheet which is attached to the underside of transport belt 30 is transported to a utilization device. The mechanical fitting between support frame 14 and shaft 22 is such that there is a slight pivoting between the frame and the shaft. The slight pivotal action allows the left and right vacuum lifting assemblies 34 and 36, respectively (FIG. 2) to descend onto a stack of sheets (not shown) in support tray 38.

Still referring to FIG. 1, an auxiliary frame is fixedly mounted to shaft 22. The auxiliary frame supports the vacuum lifter assemblies 34, 36 and the vacuum plenum for endless vacuum transport belt 30. The auxiliary frame comprises of side members 40 and 42 respectively. The side members are mounted in spaced relationship with respect to each other. A vacuum plenum 44 (FIG. 4) is fixedly mounted to the side members 40 and 42, respectively. The vacuum plenum is mounted between drive and idler rollers 28 and 46 respectively. As was stated previously, the transport belt 30 is coupled over the drive and idler rollers 28 and 46 (FIG. 1). As will be explained subsequently, only the leading portion 48 (FIG. 4) of the vacuum plenum is open (that is vented to atmosphere). The vented portion of the plenum generates the vacuum force which holds a sheet attached to the undersurface of vacuum transport belt 30. The vacuum plenum 44 includes an inlet port 49. A hose 50 (FIG. 3) is connected to the inlet port and is also coupled to a vacuum pump (not shown). The hose delivers the vacuum (that is negative pressure) to the plenum 44. Still referring to FIG. 1, a front idler roller 46, is slidably coupled to side members 40 and 42 respectively. The idler roller 46 has a barrel-shaped surface thereon. The cross-sectional radius of the roller is greatest within the center region. This affords proper tracking of the transport belt relative to the surface. The roller is supported by bearings (not shown) and rotates relative to shafts 142, 144 (FIG. 2) respectively. A pair of flat surfaces are diametrically disposed on each shaft. The flat surfaces slides and fit firmly into slots 146 and 148 respectively. An adjustment mechanism is coupled to shaft 144. In the preferred embodiment, the adjustment mechanism is a threaded screw attached to the shaft. The shank of the screw extends parallel to slot 148. A preferred configuration is that the shank of the screw is placed in the slot with the head 150 extending outwardly. By torquing the head of the screw, the idler roller 46 is positioned at variable positions along the slot. Of course, it is within the skill of the art to utilize other types of adjustment mechanisms without departing from the scope of the present invention.

As was stated previously, endless vacuum transport belt 30 is coupled to drive roller 28 and idler roller 46. In the preferred embodiment of this invention, the belt is flexible. By torquing the adjustment mechanism, the position of the idler roller is adjusted so that the axis of rotation is nonparallel relative to the axis of rotation of the drive roller. As such, the idler roller may be adjusted to control skew tracking associated with a sheet on the vacuum transport belt.

Figure 3:
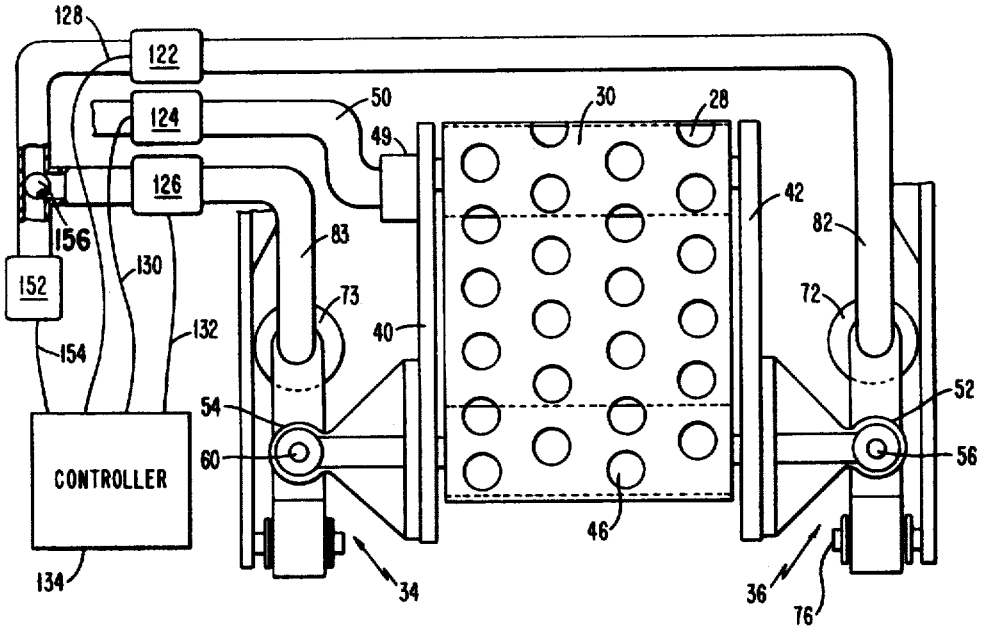
FIG. 3 is a top view of the automatic document feeder.

Referring now to FIGS. 1 and 3, a pair of linear bearing members 52 and 54 are mounted to side members 42 and 40 respectively. A shaft 56 is journaled for linear motion in a direction shown by double-headed arrow 58 within linear bearing member 52. Similarly, a shaft 60 is journaled in linear bearing members 54 for linear motion in the direction shown by double-headed arrow 62.

Turning to FIG. 3 for the moment, a drawing showing the top view of the automatic vacuum document feeder is shown. As is evident from this view, the vacuum picker assembly includes a left vacuum lifting assembly 34 and a right vacuum lifting assembly 36. The left vacuum lifting assembly 34 and the right vacuum lifting assembly 36 includes shaft 60 and 56, respectively. As was stated previously, the shafts are journaled for linear motion in the linear bearing members. As such, the stroke of the vacuum picker assembly depends on the range of the motion of the shafts within the linear bearing assembly. In the preferred embodiment of this invention, the range of the picker assembly is variable. This feature enables the picker assembly to pick various weight paper without adjusting the picker assembly. Since the right and left lifting assemblies are identical, only the right assembly 36 will be described in detail, it being understood that the configuration and function of the left assembly is identical to that of the right.

Figure 2:
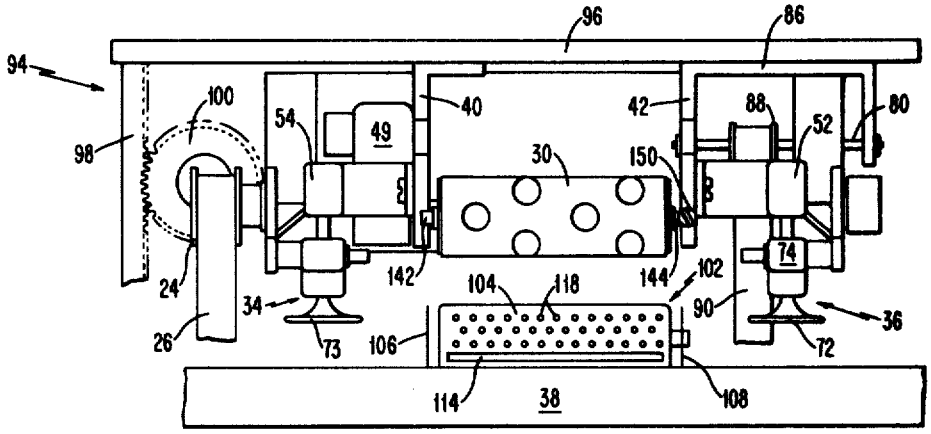
FIG. 2 is a cross-sectional view of the automatic document feed shown in FIG. 1.

Referring now to FIGS. 1, 2 and 3, the right lifting assembly 36 includes the linear bearing member 52. The linear bearing member is attached by screws 68 and 70 to side member 42. Shaft 56 is slidably mounted within linear bearing member 52. As was stated previously, shaft 56 moves in a direction parallel to arrow 58 and, as a result, the suction cup 72 contacts the topmost sheet in a stack to lift and deliver said sheet to the vacuum transport belt 30. The shaft 56 is fixedly fastened at its lower end to arcuate support arm 74. Shaft 76 is fastened to side member 18. One end of arcuate support arm 74 is slidably coupled to shaft 76. A metal tube 78 is fixedly coupled to the other end of arcuate support arm 74. A vacuum cup 72 is attached to the lower end of the metal tube. Preferably, the vacuum cup is fabricated from flexible material such as rubber. The metal tube 78 is supplied with vacuum from vacuum tube 82 (FIG. 3). It should be noted at this point that the attachment to vacuum cup 72 need not be metal. As is shown in FIGS. 5 through 8, the attachment 84 which supplies vacuum to vacuum cup 72, is fabricated from corrugated rubber which can be compressed in the vertical direction. Of course, it is within the skill of the art to use other types of attachments without deviating from the scope of the present invention.

Figure 4:
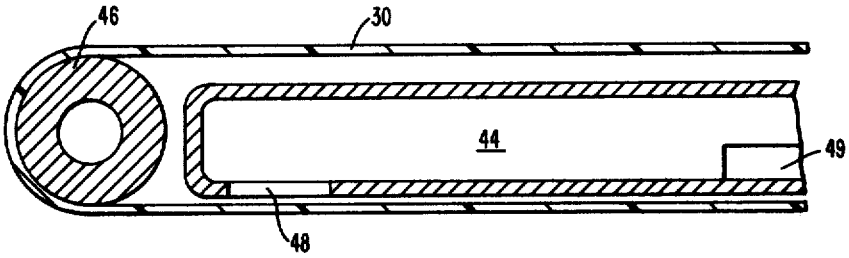
FIG. 4 shows a cross-section of the vacuum transport belt assembly.

Referring now to FIGS. 1, 2, and 4, the orientation of the vacuum suction cup 72 and 73 relative to the vacuum port 48 (FIG. 4) of the vacuum transport assembly 12, is such that the vacuum suction cups are positioned downstream from port 48 in the direction 32 of belt motion (FIG. 4). As was stated previously, vacuum outlet 48 is the port which vents plenum 44 to the atmosphere. Stated another way, the area on transport belt 30, which is associated with port 48, creates the force which attracts and holds a sheet to the undersurface of the belt. By positioning the boots 72 and 73 downstream from this port, in the direction of belt rotation as soon as a sheet is attached to the belt, when the vacuum on these boots is dropped the sheet is transferred to the belt smoothly without any rubbing action. As was stated previously and as can be seen from FIGS. 1, 2 and 3, left lifting assembly 34 and right lifting assembly 36 are identical. Both assemblies are transported in a vertical path shown by arrows 62 and 58, respectively, and simultaneously contact a sheet by suction cup 72 and 73 respectively, lifting said sheet from the top of a stack positioned in support tray 38, receding beyond the bottom surface of transport belt 30 and delivering the sheet on the belt as soon as the sheet is attached to said belt by vacuum outputted from port 48.

To this end, the motion to the left and right lifting assembly 34 and 36, is supplied by a motor/cam drive assembly. The motor/cam drive assembly includes a shaft 80 (FIGS. 1 and 2). The shaft 80 is journaled for rotation in side member 42 and overhang member 86. The overhang member 86 is integrally formed with side members 42. A grooved pulley 88 is fixedly mounted to shaft 80. A drive belt 90 couples the grooved pulley 88 to a drive motor (not shown). An eccentric lobe 81 (FIG. 5) is fitted to shaft 80. A pair of independently rotating roller bearings are mounted in side-by-side spaced relationship on the eccentric lobe. The pair of roller bearings are further mounted on the shaft in spaced relation with respect to grooved pulley 88. One of the roller bearings identified as roller bearing 91 is shown in FIGS. 5–8. The pair of roller bearings rolls on a dual cam surface 92. The dual cam surface is designed with two surfaces of contact, one for each roller bearing. The surfaces of contact are disposed one on each side of shaft 80. It should be noted that both bearings maintain contact with the surfaces at all times. However, only one bearing drives its associated surface while the other bearing simply idles or slides on its associated surface. The dual cam surface is fabricated in side member 18 (FIG. 1). As will be explained subsequently, by energizing the drive motor (not shown) each of the roller bearings will contact one surface of the dual cam surface thereby forcing the vacuum suction cups 72 and 73 to descend contacting and picking the topmost sheet from a document stack and lifting the same to deliver it to the vacuum belt. It should be noted that other types of drive mechanisms may be used without departing from the scope of the present invention.

Referring now to FIG. 2, rack/gear assembly 94 is used to position the automatic vacuum document feeder 10 (FIG. 1) relative to a stack of sheets (not shown) in tray 38. In the preferred embodiment of this invention, the rack/gear assembly 94 is used for initializing (that is positioning) vacuum cup 72 and 73 respectively, relative to the topmost sheet in the stack. Once the initializing process has been achieved, the rack/gear assembly is locked in the initial position and is not changed. The lifting of sheets from the stack is then performed by the downward and upward (descent/ascent) motion of the picker boots 72 and 73, respectively. Stated another way, the lifting function is done by the varible stroke lifting assembly. To this end, a support plate 96 is fixedly attached to side member 40 and overhang member 86. A rack 98 is mounted to the support plate 96. A gear 100 is fixedly mounted in the vertical plane to a back plate (not shown). The gear is driven by a motor pulley assembly (not shown). By activating the motor, the automatic document feeder is adjusted in the vertical plane. The vacuum boots 72 and 73, of the automatic document feeder, are adjusted in the vertical plane relative to a pile of sheets in the stack. Of course, other types of adjustment mechanisms may be used without departing from the scope and teaching of the present invention.

Figure 9:
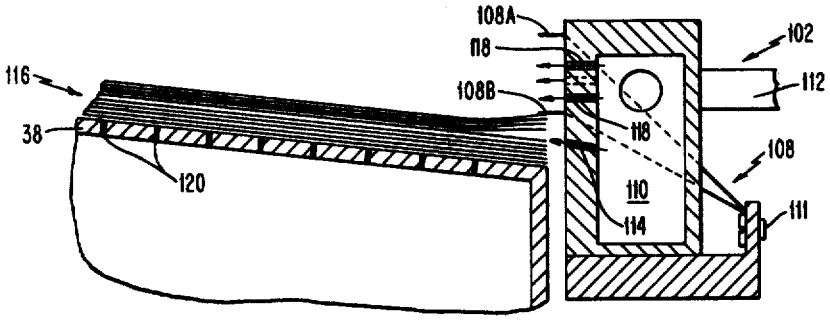
FIG. 9 shows a separator disposed relative to the stack.

In order to prevent double feed, a separator restraint means 102 (FIG. 2) is disposed relative to tray 38 at the leading edge of the stack. The separator restraint means 102 includes a sheet separator/sheet stabilizing assembly 104, and a pair of restraining fingers 106 and 108 respectively. The restraining fingers are disposed one on opposite sides of the separator/stabilizing assembly 104. Front views, cross-sectional views and side views of the separator restraint assembly 102 are shown in FIGS. 2, 9, and 5–8, respectively. The separator stabilizer assembly 104 includes a pressure plenum 110 (FIG. 9). An air inlet port 112 supplies pressurized air to the plenum. The plenum 110 is fitted with an angled slot 114. In the preferred embodiment of this invention, the slot is inclined at approximately 10° with respect to the horizontal. In operation, jets of air are outputted from the slots to fluff the topmost sheet or sheets from a pile of sheets 116 located in support tray 38. A plurality of holes 118 (FIGS. 2 and 9) are disposed in the pressure plenum 110. The orientation of the holes are normal with respect to the vacuum plenum. Air is outputted from these holes on the top of the sheets to stabilize the sheets within support tray 48 when top sheet is being separated from the remainder of the stack. Particularly, it should be noted at this point that the stack in support tray 48, flies relative to said tray as a result of air outputted through a plurality of holes 120 in the tray 38 (FIG. 9). A pair of separator fingers 108 and 106 are mounted, one on each side of the stabilizer/separator assembly. As can be seen in FIG. 9, restraining finger 108 includes two wires 108A and 108B, mounted by screw 111 to a support plate. Similarly, restraining finger 106 include a pair of wires, 106A and 106B, mounted to a support frame (FIGS. 5–8). As will be explained subsequently, as the angled air jets fluff the topmost sheets in pile 116, and the lifter leg removes the topmost sheet, the bottom sheets are prevented from attaching to the topmost sheet by the separator wires 108A, 108B, 106A and 106B, respectively.

Turning now to FIG. 3, the controller for the automatic vacuum document feeder is shown. As was stated previously, each of the vacuum cups 72 and 73 is supplied with independent vacuum from tubes 82 and 83 respectively. Also, the vacuum plenum 44 of the horizontal transport assembly is supplied with vacuum through vacuum tube 50. Each of the vacuum tubes 50, 82 and 83 is fitted with a sensor means 122, 124 and 126, respectively. Each of the sensor means includes a conventional pressure valve with a conventional pressure transducer. Since these devices are well known in the prior art, the details of each will not be given. Suffice it to say that changes in pressure in the vacuum tubes 82, 83 or 50 will generate an electrical signal on conductor 130, 132 and 128, respectively. The signal are utilized by controller 134 to manipulate the transport belt and the vacuum picker cups so that a sheet is transported smoothly from the picker cups to the transport belt.

A vacuum valve 156 is placed within vacuum tubes 82 and 83 respectively. The function of this valve is to control vacuum (negative pressure) in tubes 82 and 83. The vacuum is supplied from a vacuum source (not shown). A solenoid 152 is coupled to the valve and controls the closing and opening of the valve. Conductor 154 transmits electrical signals between the solenoid and the controller.

Figure 11:
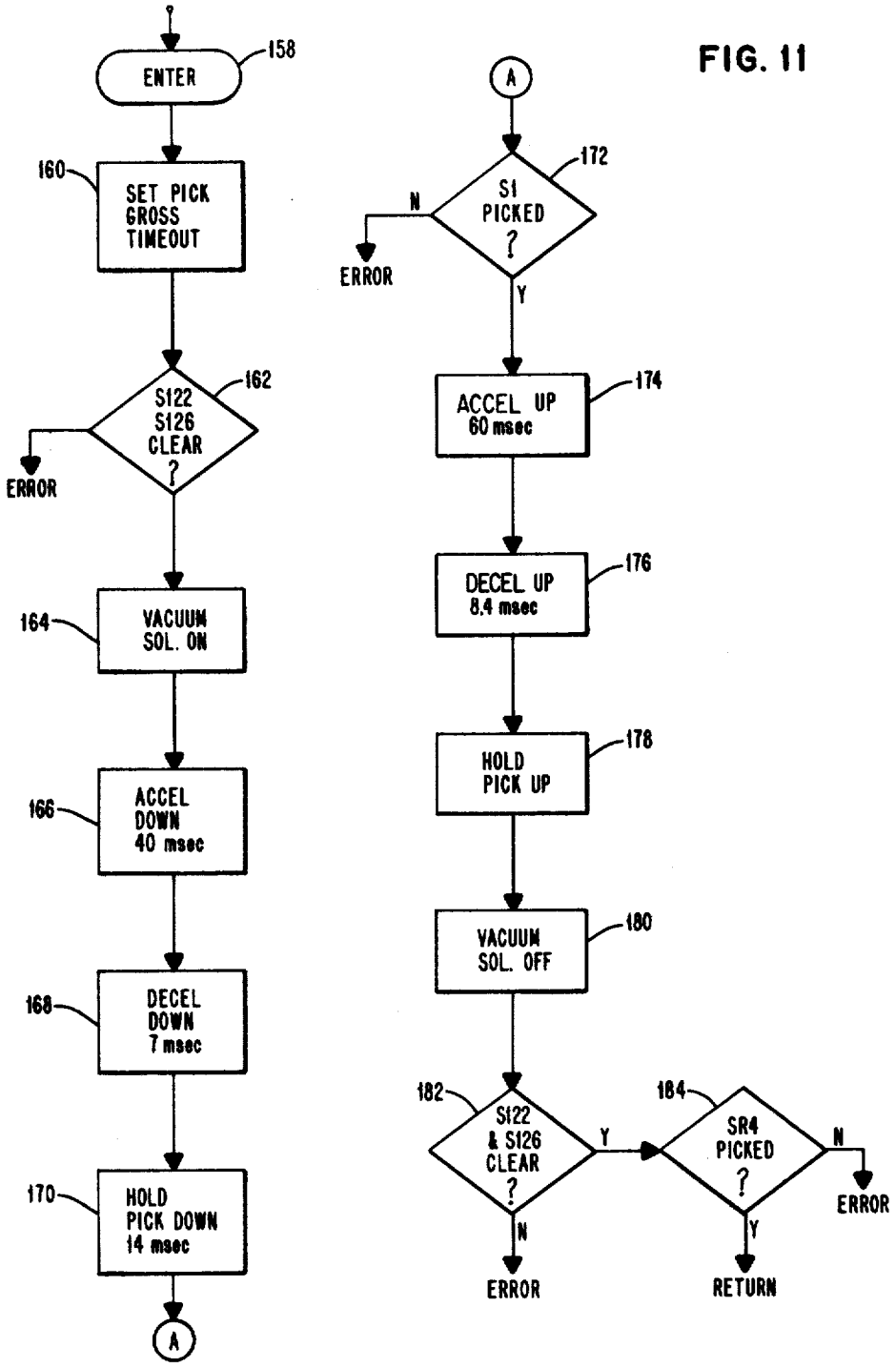
FIG. 11 shows a flowchart of the process steps necessary to program the controler.

Turning now to FIGS. 3 and 11, the controller 134 (FIG. 3) may be designed in discrete logic. However, in the preferred embodiment of this invention, a microcomputer is used as a controller. Any conventional microcomputer can be used. For example, the Motorola 6800 computer is a suitable one. Such a microcomputer has its instruction set and it is within the skill of the art to program said computer in accordance with the process steps shown in FIG. 11 and to be described shortly. The first block in the routine is blocked 158. This is an entry block, and the microcomputer enters the pick routine via this block. From block 158, the microcomputer enters the set pick gross timeout block 160. This block is used to set up preliminary timeout conditions. Essentially, if within a particular time period, a sheet of paper is not picked, then the microcomputer generates an error signal and the device is turned off. The microcomputer then enters the decision block 162. In this block, the microcomputer samples the signals from sensors 122 and 126 respectively. The sensors are associated with the picker assembly. If the signals from the sensors are in a first state (say negative), then an error signal is generated. If the signal from the sensor are in a second state (say positive), the program then enters a functional block 164. In this block, the microcomputer samples the vacuum solenoid 152 to see if it is on. The microcomputer then enters the functional block 166. In this block, the picker assembly is accelerated down (ACCELDOWN) for a period of time. In the preferred embodiment of this invention, the acceleration is for 40 milliseconds. The microcomputer then enters functional block 168 where the picker assembly decelerates down for a period of 7 milliseconds. The microcomputer then enters positional block 170. The picker assembly is held in the down position for a predetermined period of time. In the preferred embodiment, this invention is approximately 14 milliseconds. The microcomputer then enters positional block 172. In this block, the microcomputer tests to see that the pneumatic sensors 122 and 126 are in a predetermined state. If the sensors are in the predetermined state, this signifies that a sheet has been picked. In such a case, the microcomputer accesses functional block 174. In this block, the picker assembly is accelerated upwards for a predetermined period of time. In the preferred embodiment of this invention, the picker assembly is accelerated upwards for 60 milliseconds. The microcomputer then enters the functional block 176. In block 176, the picker assembly is decelerated up for a predetermined period of time. In the preferred embodiment of this invention, the deceleration time is approximately 8.4 milliseconds. The microcomputer then enters the functional block 178 where the picker assembly is held up for a period of time. From block 178, the microcomputer enters block 180 where the vacuum solenoid to the picker assembly is turned off. The microcomputer then enters decisional blocks 182 and 184, respectively, where it tests to see that the sensors associated with the picker assembly is in one state indicating that paper has been transferred and then test to see that the sensor associated with the vacuum belt is in another state indicating that paper is securely attached to the belt. If all these conditions are positive, the microprocessor then returns and the routine is repeated. The routine is repeated until all the sheets are fed out from the document tray.

Figure 5:
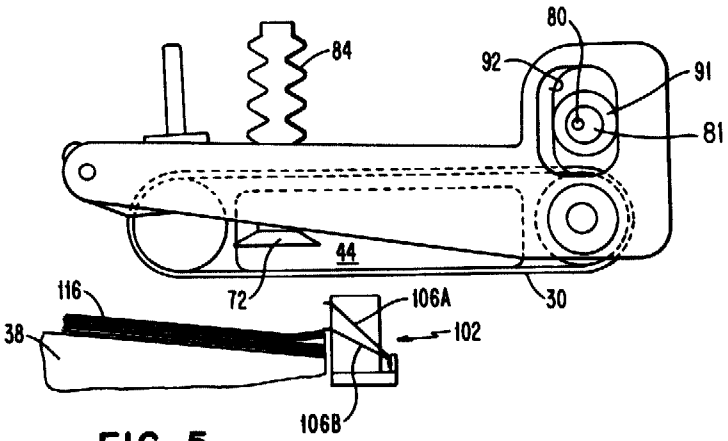
FIG. 5 shows a side view of the automatic document feeder with the picker foot in a retractable position.

FIGS. 5–8 show the various position of vacuum cup 72 relative to stack 116 as it attempts to remove the topmost sheet from the stack and delivering the same to vacuum belt 30. It should be noted that by positioning the picker cups 72 and 73 relative to the leading edge of stack 116, the stiffness of the paper appears to be relatively constant. As such, variable weight paper can be picked without adjusting the picking mechanism. It should be understood that the identical steps are being performed concurrently by the other picker cup 73. In FIG. 5, the picker cup 72 is shown in its upmost position. This position may be considered to be at the top of the stroke for the picker assembly.

Figure 6:
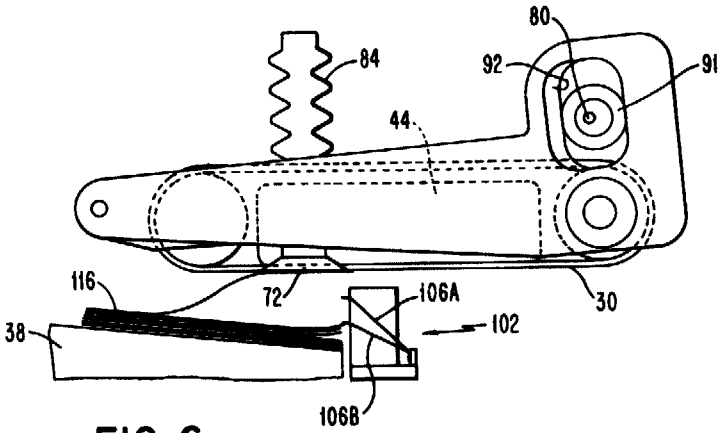
FIG. 6 shows a side view of the automatic document feeder with a sheet attached to the picker foot.
Figure 8:
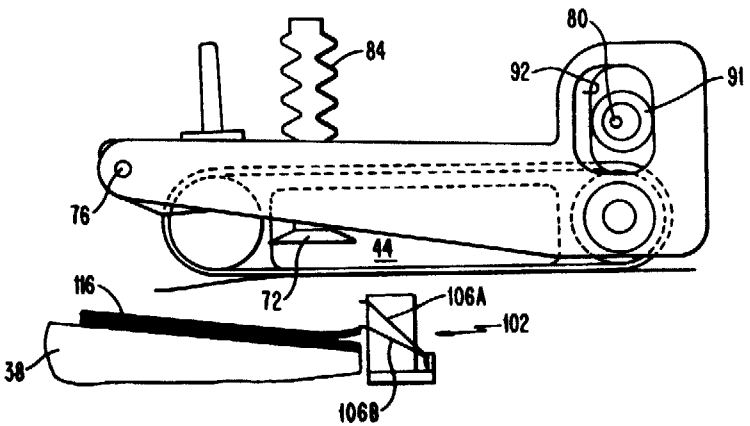
FIG. 8 shows a sheet attached to the vacuum transport belt of the automatic document feeder.
Figure 7:
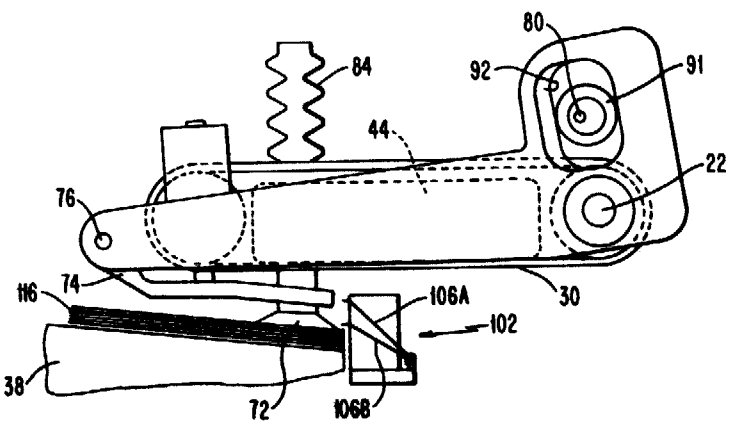
FIG. 7 is a side view of the automatic document feeder with the picker foot positioned on a stack of sheets.

In FIG. 7 the picker cup is driven downwardly by the motor cam assembly previously described and now sits on the topmost sheet in stack 116. In FIG. 6 the topmost sheet is lifted from the stack through a vertical path and as the cup retracts beyond the bottom surface of belt 30, the sheet is dislodged to said belt. Dual sheet feeding is prevented by the document restraint means. In FIG. 8 the picker cup 72 is in its uppermost position with the sheet being transported by the transport vacuum belt 30. The sheet is delivered to a utilization device such as a convenience copier.

Figure 10:
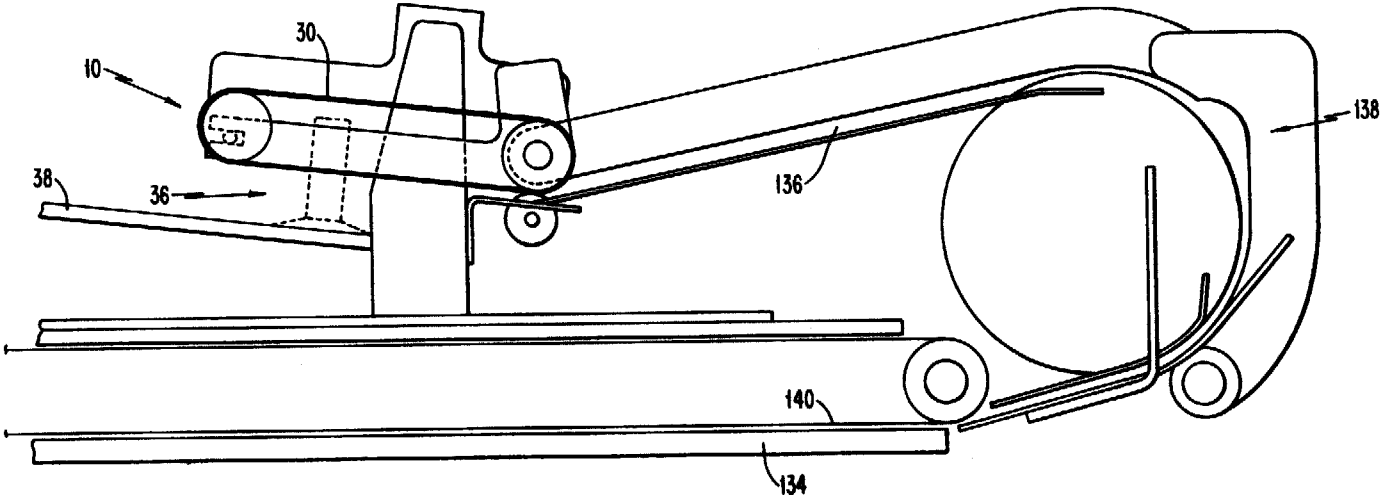
FIG. 10 shows a schematic of the automatic document feeder delivering sheets to a convenience copier.

Turning now to FIG. 10, the automatic document feed is shown in a configuration where it is supplying original documents (not shown) to the document platen 134 of a convenience copier. A stack of documents (not shown) is placed into support tray 38. The picker mechanism, including vacuum lifting assemblies 34 and 36, lifts the topmost sheet from the stack and transfers the sheet to vacuum transport belt 30. From the vacuum transport belt 30, the sheet is transferred through entry channel 136, turn-around 138, onto vacuum transport means 140. The vacuum transport means 140 position the sheet so that copies of its contents are formed on the photoconductive surface of the copier.

OPERATION

In operation, the rack and pinion assembly 94 (FIG. 2) initializes the automatic vacuum document feeder 10 (FIG. 1) relative to a stack of sheets 116 (FIG. 9) positioned in tray 38 of said device. The pressure supplied to pressure plenum 110 (FIG. 9) is activated and air escaping from angled slot 114 fluffs (that is separates) the uppermost sheet or sheets in stack 116. Simultaneously, air escaping from holes 118 equalizes the pressure on the stack in the tray. A variable stroke picker assembly including the left and right picker assembly, 34 and 36, respectively, are descended under control of motor driven cam assembly, until the suction cups 72 and 73, respectively, are sealed off by the topmost sheet in the stack. At this point, electrical signals are generated on conductor 130 and 132. The electrical signals are correlated by controller 134 and the motor-driven cam assembly is activated so that the picker assembly traverses a vertical path lifting the topmost sheet above stack 116. Double feeding of sheets is prohibited by the document restraint means. The picker assembly recedes in the vertical plane until it is at a point beyond the bottom surface of the transport belt 30. At that point, the sheet closes off the active vacuum port in the belt plenum and a signal is generated on conductor 128. The signal together with a time-out signal, is correlated by controller 134. The correlated signal is used to turn off the vacuum to vacuum cup 72 and 73. The sheet is then dislodged to the transport belt where it is transported to a convenience copier.

While the invention has been particularly shown and described with reference to the preferred embodiment thereof, it will be understood by those skilled in the art that various changes in form and details may be made therein without departing from the spirit and scope of the invention.

What is claimed is:

1. A vacuum automatic document feeder for feeding single documents from a document stack onto the document platen of a convenience copier comprising in combination:

a means for supporting the stack;

a pair of vacuum picker assembly means disposed above the stack, said pair of vacuum picker assembly means being operable to lift the topmost sheet and to transport said sheet through a straight path to a transition zone above the stack;

a vacuum transport means disposed at the transition zone, said vacuum transport means being orientated in a plane perpendicular to the straight path;

a valve means operable to control vacuum to said pair of vacuum picker assembly means;

a switch means operable to control the closing and opening of said valve means;

a pressure sensing means coupled to the pair of vacuum picker assembly means and the vacuum transport means, said pressure sensing means being operable to sense pressure therein; and a programmed microcomputer responsive to signals outputted from the pressure sensing means and operable to enable the switch means after a predetermined time-out interval so that the vacuum to the pair of vacuum picker assembly means is dropped when said pair of vacuum picker assembly means is positioned relative to the bottom surface of the vacuum transport means whereby the sheet is dislodged without relative motion onto the vacuum transport means.

2. The automatic document feeder of claim 1 further including a positioning means operable to position the vacuum picker assembly means and the vacuum transport means relative to a stack.

3. The automatic document feeder of claim 2 wherein the positioning means includes a rack and pinion gear assembly; and a drive motor coupled to said assembly.

4. The document feeder of claim 1 further including a document separator/restraint means disposed relative to the stack, said document separator/restraint means being operable to fluff and restrain the sheets so that only a single document is removed from the stack.

5. The automatic document feeder of claim 4 wherein the document separator/restraint means includes an air bearing means with a slot through which air jets are directed at the sheets; and a pair of stripper fingers positioned in spaced relation at opposite ends of the slot.

6. The document separator/restraint means of claim 5 further including a plurality of holes disposed relative to the slot and operable to supply airflow to equalize the vacuum pressure on said stack.

* * * * *